United States Patent [19]

Hosan et al.

[11] Patent Number: 4,940,202

[45] Date of Patent: Jul. 10, 1990

[54] STEPLESSLY ADJUSTABLE VERTICAL MOVEMENT DEVICE

[75] Inventors: Hans-Josef Hosan, Neuwied; Axel Knopp, Eitelborn, both of Fed. Rep. of Germany

[73] Assignee: Stabilus GmbH, Koblenz-Neuendorf, Fed. Rep. of Germany

[21] Appl. No.: 403,915

[22] Filed: Sep. 1, 1989

Related U.S. Application Data

[63] Continuation of Ser. No. 312,402, Feb. 17, 1989, abandoned, which is a continuation of Ser. No. 142,243, Dec. 30, 1987, abandoned, which is a continuation of Ser. No. 29,358, Mar. 23, 1987, abandoned, which is a continuation of Ser. No. 783,771, Oct. 3, 1985, abandoned.

[30] Foreign Application Priority Data

Oct. 10, 1984 [DE] Fed. Rep. of Germany ..... 3437097

[51] Int. Cl.[5] ..... F16M 11/00

[52] U.S. Cl. ..... 248/162.1; 248/123.1; 297/347

[58] Field of Search ..... 248/162.1, 161, 123.1, 248/297.1, 188.2; 297/347; 108/147; 188/321.11

[56] References Cited

U.S. PATENT DOCUMENTS

| | | | |
|---|---|---|---|
| 2,468,939 | 5/1949 | Mercier | 188/321.11 |
| 3,285,207 | 11/1966 | Von Hagen . | |
| 3,339,873 | 9/1967 | Hale | 297/347 |
| 3,436,048 | 4/1969 | Greer . | |
| 3,711,054 | 1/1973 | Bauer . | |
| 3,788,587 | 1/1974 | Stemmler . | |
| 3,790,119 | 2/1974 | Bauer | 248/161 |
| 3,913,901 | 10/1975 | Molders . | |
| 3,920,209 | 11/1975 | Komura | 248/162.1 |
| 4,108,416 | 8/1978 | Nagase et al. . | |
| 4,183,689 | 1/1980 | Wirges et al. . | |
| 4,286,765 | 9/1981 | Delgleize et al. | 248/161 |
| 4,408,800 | 10/1983 | Knapp | 297/347 |
| 4,431,092 | 2/1984 | Kloster | 188/321.11 |
| 4,485,996 | 12/1984 | Beukema et al. . | |
| 4,580,749 | 4/1986 | Howard . | |
| 4,756,496 | 7/1988 | Hosan et al. . | |

FOREIGN PATENT DOCUMENTS

| | | |
|---|---|---|
| 0034068 | 8/1981 | European Pat. Off. . |
| 7711610 | 9/1977 | Fed. Rep. of Germany . |
| 8321916 | 11/1983 | Fed. Rep. of Germany . |
| 8417962 | 9/1984 | Fed. Rep. of Germany . |

OTHER PUBLICATIONS

Assido, Das Arbeitsstuhl-Programm von Bremshey, p. 12.

*Primary Examiner*—Ramon O. Ramirez
*Assistant Examiner*—Robert A. Olson
*Attorney, Agent, or Firm*—Brumbaugh, Graves, Donohue & Raymond

[57] ABSTRACT

For a steplessly adjustable vertical movement device for chairs, tables or the like articles, which comprises a blockable gas spring which is arranged in a telescopic unit consisting of a telescopic tube and a guide tube and is connected by means of self-locking taper connections on the one hand with the chair seat or a similar article of adjustable height and on the other hand with a foot part, a simple replacement of the gas spring is to be provided, while security against unintended unscrewing of the gas spring is guaranteed. The gas spring should here be as simple as possible in construction, permit easy assembly and dismantlement and be arranged as freely as possible from bending stresses in the telescopic unit. This is achieved in that for the connection of the gas spring with the telescopic tube one of the components is provided with at least one threading-type depression which, in the fitting of the gas spring in the telescopic tube, is penetrated by at least one projection provided on the other component, an end face situated on the end of the depression forming an axial stop with the projection.

28 Claims, 7 Drawing Sheets

STEPLESSLY ADJUSTABLE VERTICAL MOVEMENT DEVICE

This application is a continuation of application Ser. No. 312,402, filed on Feb. 17, 1989, now abandoned, which is a continuation of U.S. application Ser. No. 142,243, filed on Dec. 30, 1987, now abandoned, which is a continuation of U.S. application Ser. No. 029,358, filed on Mar. 23, 1987, now abandoned, which is a continuation of U.S. application Ser. No. 783,771, filed on Oct. 3, 1985, now abandoned.

BACKGROUND OF THE INVENTION

Modern chairs, tables and similar height-adjustable articles are adjusted in height by the aid of steplessly adjustable vertical movement devices using voluntarily lockable gas springs.

STATEMENT OF THE PRIOR ART

The connection of such steplessly adjustable vertical movement devices for the one part with the chair seat, the table top or the like articles and for the other part with the foot part is effected by self-locking taper connections. Such taper connections render very simple assembly possible, but after lengthy use, as a result of the forces acting on them, they no longer can be disengaged without damage to guide parts. In such articles it is necessary for the gas spring to be easily replaceable in the case of any defect. For this purpose according to German Utility Model No. 83.21,916 it is known to arrange the gas spring with sliding fit in the telescopic tube, with a securing element provided at the lower end of the telescopic tube. It is disadvantageous that, due to the sliding fit between telescopic tube and gas spring housing the diameters of the parts must be made with very close tolerances in order to guarantee that the gas spring is replaceable. Accordingly such a construction becomes dear in production, and the gas spring housing is subject to bending stresses.

It is proposed by German Patent Application P 34 20 528.4 corresponding to U.S. patent application Ser. No. 736,563, filed May 21, 1985, now U.S. Pat. No. 4,756,496, to use screw connections, bayonet-catchtype connections or snap connections for the connection of the gas spring with the telescopic tube. These types of connection are disadvantageous in as much as unintentional slackening of the gas spring in the telescopic tube during use cannot be reliably avoided. Especially if the clamping position is arranged at the piston rod exit end of the gas spring and the support face is situated at the other end of the container it is not possible to exclude the possibility of the gas spring having to take up bending stresses.

OBJECT OF THE INVENTION

It is the object of the present invention to provide a steplessly adjustable vertical movement device in which the securing of the gas spring in the telescopic tube is secured against unintentional slackening of the gas spring, the gas spring is itself kept as free as possible from bending stress and is simple in assembly, and both easy assembly and replaceability of the gas spring are rendered possible.

SUMMARY OF THE INVENTION

In view of the above object a steplessly adjustable vertical movement device for chairs, tables or the like comprises a voluntarily blockable gas spring which possesses a container and is secured therewith in a telescopic tube. A piston rod emerging downwards from the container and guided in sealed manner in relation to the interior of the container is detachably connected with a guide tube arranged on the telescopic tube for sliding by means of a guide bush. The telescopic tube comprises a taper at the upper end for connection with a part of adjustable height; the guide tube is connected with a foot part. For the securing of the gas spring in the telescopic tube a connection is provided which presses the gas spring, for the formation of an axial stop, with an upper end face against a stop face situated on the taper end. For the connection of the gas spring with the telescopic tube one of the components is provided with at least one threading-type depression which, in the fitting of the gas spring in the telescopic tube, is penetrated by at least one projection connected with the other component. An end face situated on the end of the depression forms a further axial stop with the projection.

In this simple manner an easily disengageable connection of a gas spring in a telescopic tube is produced which after assembly permits a slight mobility of the gas spring in the telescopic tube between two stops. In this case the gas spring is free from bending stresses, which are taken up only by the telescopic tube and guide tube. Most extensive securing against unintended slackening of the gas spring in the telescopic tube is guaranteed, while the connection takes place with very simple means and permits easy assembly and dismantlement. In accordance with a further aspect of the invention it is advantageous that the threading-type depression is arranged in the telescopic tube, while the projection is connected with the gas spring. This threading-type depression can here be formed by one or more grooves; likewise one or several projections can be arranged for engagement in these grooves. According to a further feature of the invention this threading-type depression in the telescopic tube is formed by an internal threading which can be produced simply at a worth-while price.

In further development of the invention the projection is formed by a threaded section connected with the gas spring which, in the condition with the gas spring fitted in the telescopic tube, passes through the internal threading and is out of thread engagement, while the threading ends form the further axial stop. This further axial stop is what is called a traction stop between the gas spring and the telescopic tube, coming into effect in practice only on lifting of the article. Accordingly unscrewing of the gas spring out of the telescopic tube is possible only if there is a tension stressing between the gas spring and the telescopic tube, that is to say if deliberate release of the gas spring out of the telescopic tube is to take place, in which case the spring must be pulled downwards for unscrewing. According to a further feature of the invention, the threaded section is arranged on a distance piece connected with the container, while the crimped-over taper end has an internal threading the axial extent of which corresponds to that of an unthreaded section on the distance piece.

In a further form of embodiment in accordance with the invention the threaded section is arranged on a securing ring situated at the piston rod exit end of the container, while the internal threading is situated at the lower end of the telescopic tube and the further axial stop is formed by the threading ends lying opposite to one another.

If further development of the invention good securing against unintended slackening of the gas spring out of the telescopic tube is obtained in that the projection is formed by a plurality of prongs formed in uniform distribution on the circumference of a pronged ring, which are made capable of engaging in the internal threading and, when the gas spring is in the condition fitted in the guide tube, rest with the abutment faces on the upper end of the internal threading. According to a further feature of the invention, this pronged ring is an elastic component which for rotation-fast connection possesses at least one inner surface of spanner face type which rests on a corresponding counter-surface of the distance piece. A very simple connection of the pronged ring on the distance piece is obtained according to a further feature in that the pronged ring is fastened on the distance piece by means of a press connection. This results in a facilitation in assembly, since in manufacture the gas spring is inserted without a pronged ring into the telescopic tube and then the pronged ring is fitted from above on to the distance piece, which is designed with profiled form, and is pressed to abutment thereon by means of an assembly device. In case of repair the gas spring can be removed from the telescopic tube by rotation to the left, whereby the pronged ring moves through the threading. Admittedly the replacement gas spring must be provided with the pronged ring from the outset and screwed from beneath into the internal threading.

According to another aspect of the invention a steplessly adjustable movement device comprises a voluntarily lockable gas spring. The gas spring includes a container having an axis, a cavity, an upper end, a lower end, a piston rod sealingly passing through said lower end, a piston connected with said piston rod within said cavity and dividing said cavity into two working chambers, a connection passage between said working chambers, a closing valve within said connection passage, a valve-actuation push member extending beyond the upper end of the gas spring in axial direction and being intended for the voluntary operation of said closing valve, and a pressurized gas within said cavity. The container of the gas spring is received by a telescopic tube and is releasably fastened within said telescopic tube by fastening means. The fastening means include an axially acting compression abutment system between the upper end of said container and the upper end of said telescopic tube. The fastening means further comprise a combination of two cooperating thread elements on said container and said telescopic tube, respectively, said thread elements in the assembled condition of said movement device being out of thread engagement and engaging each other with axially opposed, substantially axially directed thread end faces such as to define a traction abutment system, said thread elements being threadable with respect to each other in order to release said container from said telescopic tube. The telescopic tube is in an upper section thereof provided with an upwardly converging external cone for the engagement into a corresponding internal cone of the chair, table or similar object. The telescopic tube is with a lower section thereof slidably received by a guide tube preferably through the aid of a guide bush. The piston rod is at a location thereof outside said container connected with a bottom part of said guide tube by connection means, said connection means fixing said piston rod with respect to said guide tube in axial direction. The guide tube is shaped such as to be connectable with a foot member of the respective chair, table or similar object.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive manner in which there are illustrated and described preferred embodiments of the invention.

BRIEF DESCRIPTION OF THE DRAWINGS

The invention will now be explained in greater detail by reference to various examples of embodiment, wherein.

DESCRIPTION OF THE PREFERRED EMBODIMENTS

Figure 1:
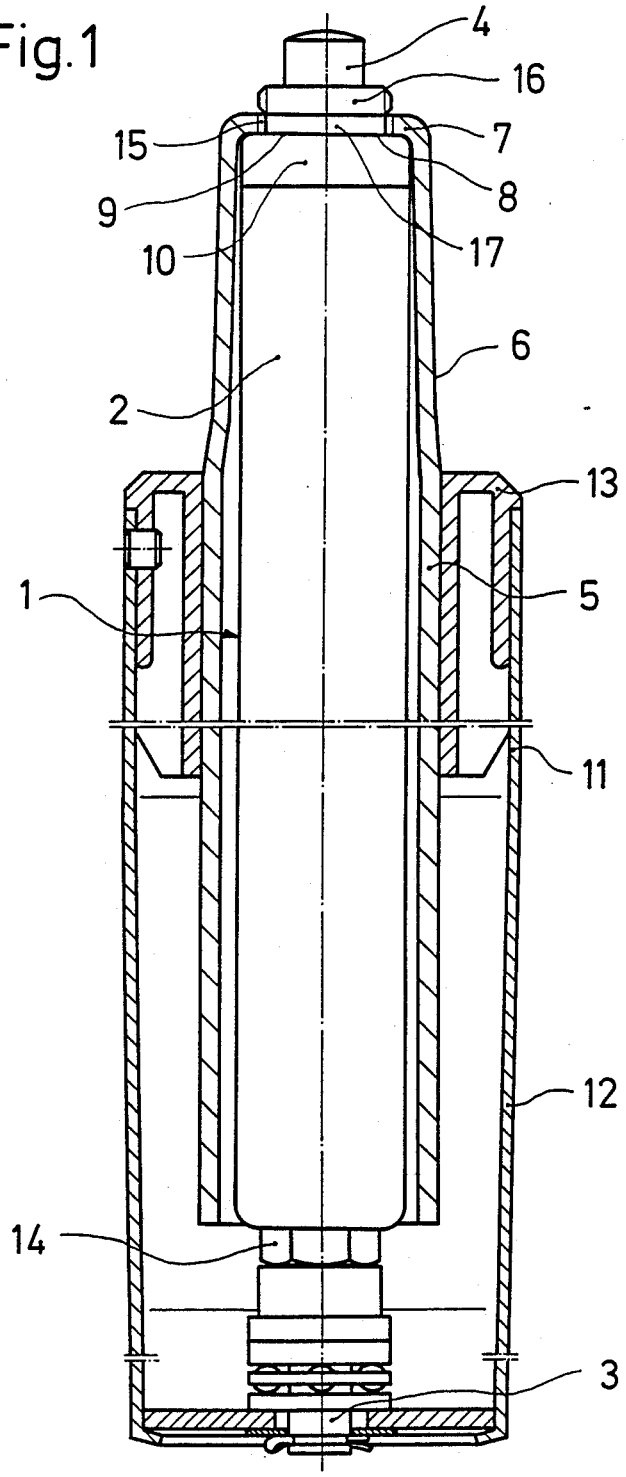
FIG. 1 shows a steplessly adjustable vertical movement device in longitudinal section.

The steplessly adjustable vertical movement device as shown in FIG. 1 for chairs, tables or the like articles comprises a blockable gas spring 1, the container 2 of which is connected with a telescopic tube 5, while a piston rod 3 emerging downwards from the container 2 is in connection with a guide tube 11. This piston rod 3 is supported through an axial bearing on the bottom part of the guide tube 11 and is connected with the latter by means of an annular washer and a split pin. A blocking valve situated in the interior of the container 2 can be opened by means of a valve-actuation push member 4, whereby an adjustment of height is rendered possible. The telescopic tube 5 possesses a taper 6 which serves for securing in a corresponding counter-taper of a chair seat carrier (not shown) or another article of adjustable height. At the upper end the taper 6 is provided with a crimped-over taper end 7 the inner face of which forms a stop face 8 for an upper end face 9 of a distance piece 10, and this distance piece 10 is connected with the container 2. The guide tube 11 possesses at one end a self-locking taper 12 which is connected with a foot part (not shown). On the other hand at the upper end of the guide tube 11 a guide bush 13 is provided in which the telescopic tube 5 slides. For the connection of the gas spring 1 with the telescopic tube 5 the crimped over taper end 7 is provided with an internal threading 15, while the distance piece 10 has a threaded section 16, and an unthreaded section 17 is provided between the upper end face 9 and this threaded section 16. On the lower end of the container 2 an extension 14 provided with spanner faces is provided fast in rotation with the container 2, to which a securing spanner can be applied. The screwing-in operation is shown clearly in FIG. 2, where the right half of the Figure shows the introduction of the gas spring 1 into the telescopic tube in the region of the taper 6. Here the threaded section 16 is screwed into the internal threading 15 of the crimped-over taper end 7 and turned until the threaded section 16 is screwed through the internal threading 15 so that then, as shown on the left side in FIG. 2, the internal threading 15 lies opposite to the unthreaded section 17 over the entire axial extent. Then the stop face 8 lies on the upper end face 9 and forms the axial stop 19 for the pressure direction. The mutually opposite ends of the internal threading 15 and of the threaded section 16 form the axial stop 18 acting in the traction direction. The gas spring is slightly movable between the two stops 18 and 19, so that no bending stress is exerted upon it, whereas the stop 19 takes up the whole compression load, without the threading being stressed. Accordingly during use of the articles provided with such a vertical movement device no unintended unscrewing of the gas spring out of the telescopic tube can occur.

Since for example in an assembled chair of adjustable height the taper connection 6 existing between a seat carrier plate and the telescopic tube 5 can no longer be disengaged and also the self-locking taper 12 of the guide tube 11 is not removable from a foot part (not shown), in the case of any defect the gas spring must be easily replaceable. For this purpose firstly the split pin is withdrawn from the piston rod 3 and the foot part with the guide tube 11 is removed from the piston rod 3. Next a spanner is applied to the spanner faces of the extension 14 and by rotation to the left with simultaneous pulling on the gas spring 1 the external threading of the threaded section 16 is brought into engagement with the internal threading 15. Then the gas spring 1 can be unscrewed out of the telescopic tube 5. The screwing in of a replacement gas spring takes place as described above for the assembly of the gas spring.

Figure 2:
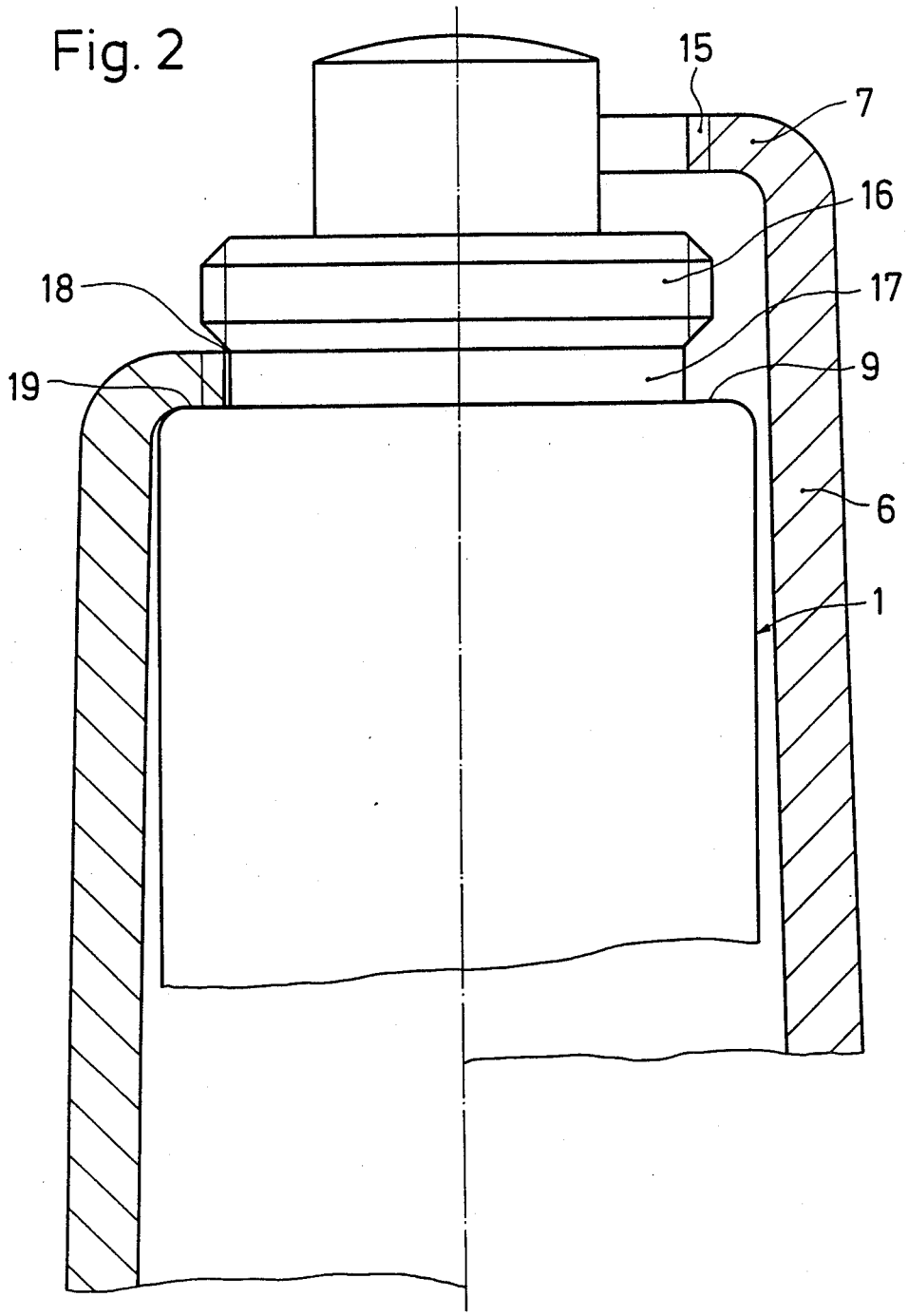
FIG. 2 shows the connection of the gas spring with the telescopic tube at the upper end of the gas spring, in enlarged representation.
Figure 3:
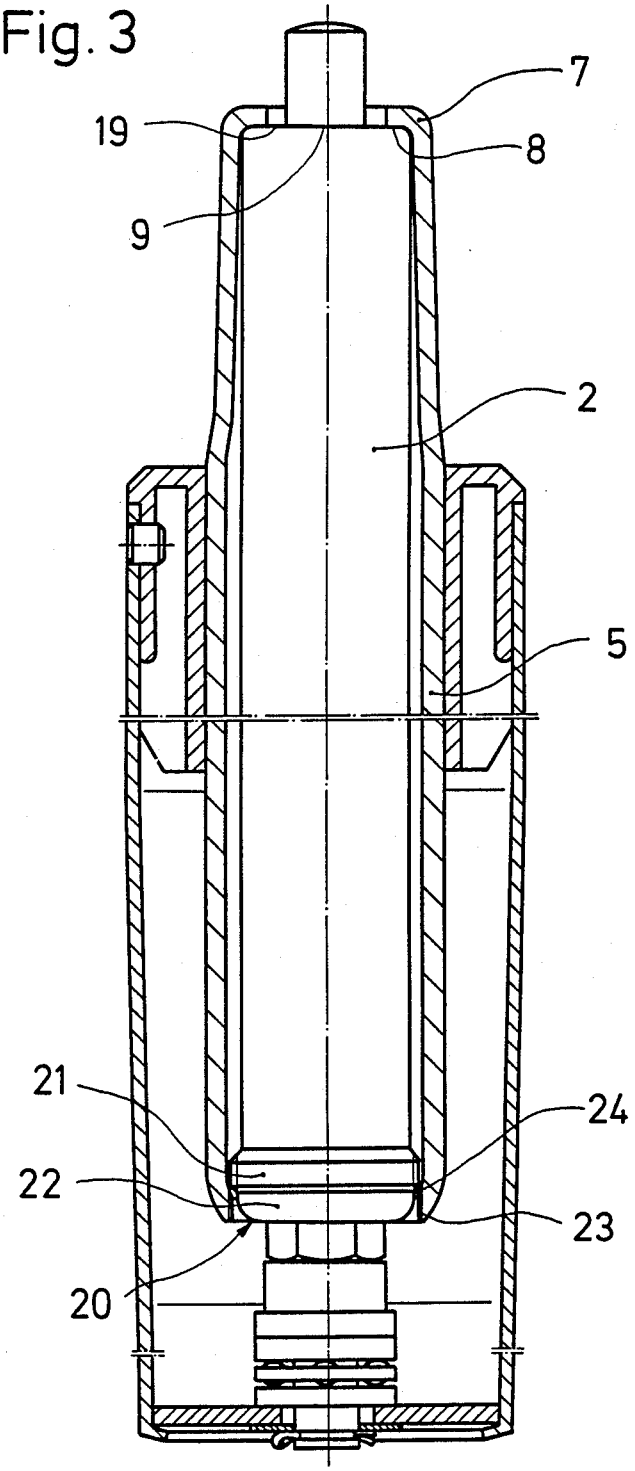
FIG. 3 shows a form of embodiment of the steplessly adjustable vertical movement device in longitudinal section, where a securing ring is provided at the piston rod exit end of the container.
Figure 4:
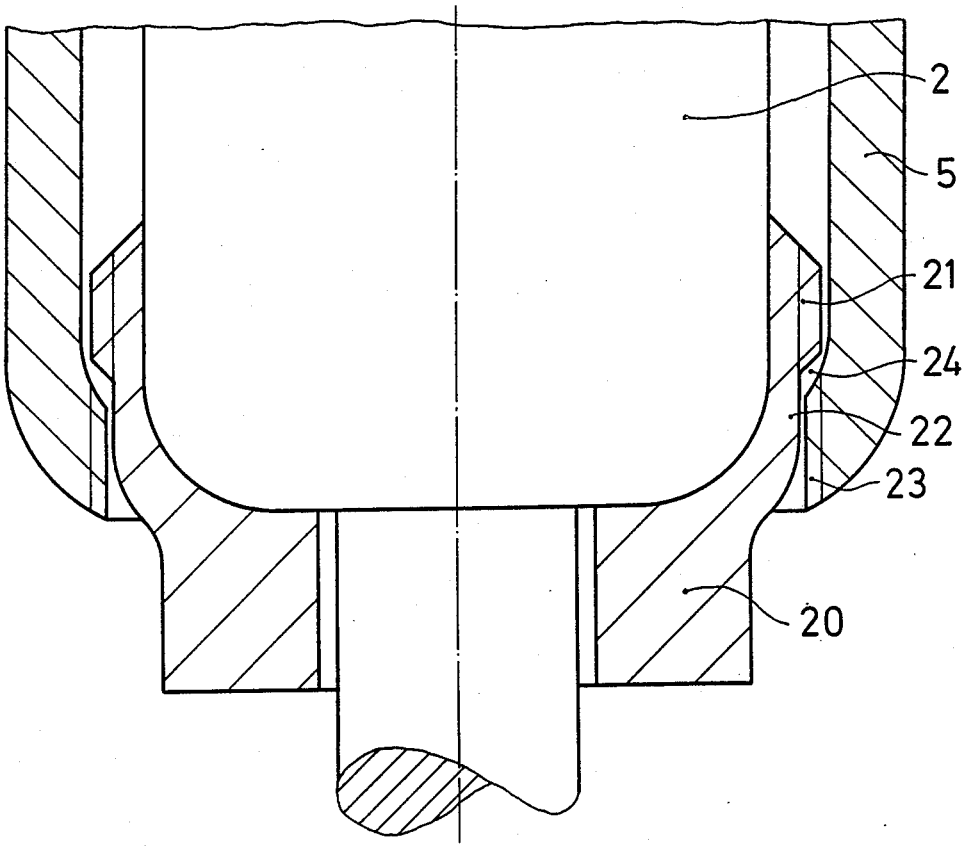
FIG. 4 shows the region of the securing ring according to FIG. 3 in enlarged representation.

The form of embodiment as shown in FIGS. 3 and 4 differs from that described above essentially in the arrangement of the axial stops 19 and 24 in relation to one another. The stop 19 which takes up the compression stress is formed, as also in the form of embodiment according to FIGS. 1 and 2, by the stop face 8 arranged internally on the crimped-over taper end 7, and the upper end face 9 of the container 2 or of a component connected with the container. The further axial stop 24 acting in the pulling direction is arranged at the piston rod exit end of the container 2 and the lower end of the telescopic tube 5. For this purpose the telescopic tube 5 has an internal threading 23 at this point, while a securing ring 20 connected with the container 2 is provided with a threaded section 21 and an unthreaded section 22. In assembly the threaded section 21 is screwed through the internal threading 23 until the internal threading 23 lies above the unthreaded section 22. The axial stop 24 acting in the pulling direction is formed by the mutually opposite threading ends of the threaded section 21 and of the internal threading 23. The replacement of a defective gas spring is effected as described for the form of embodiment according to FIGS. 1 and 2. The securing ring 20 may be fastened or integral with the container 2 or may be loose.

Figure 5:
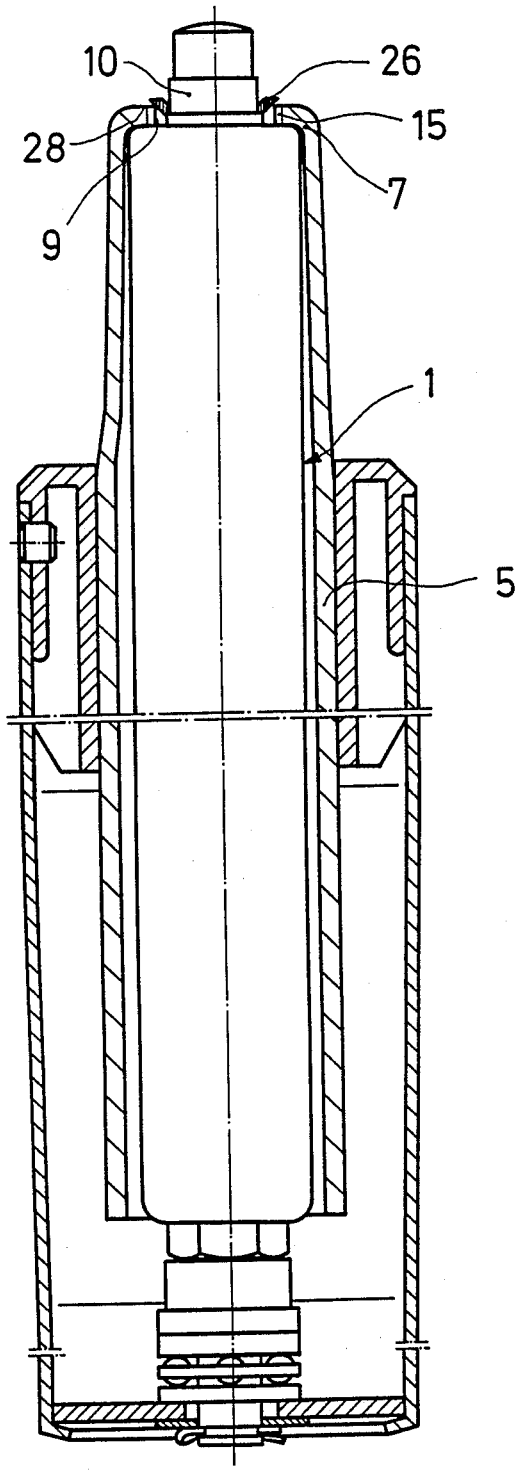
FIG. 5 shows a form of embodiment of the vertical movement device in longitudinal section in which a pronged ring is provided.
Figure 6:
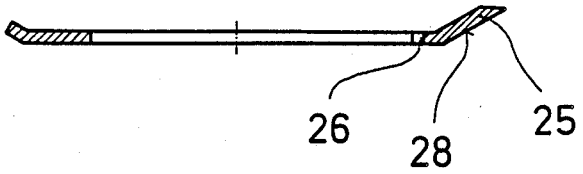
FIG. 6 shows the pronged ring according to FIG. 5 in longitudinal section and enlarged.
Figure 7:
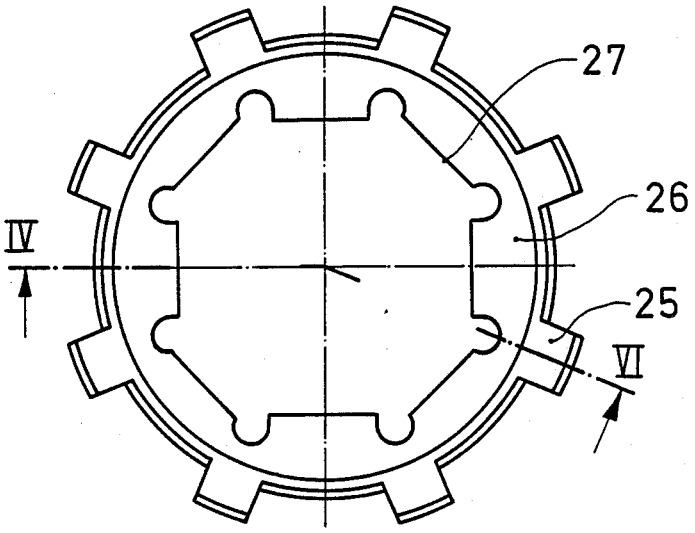
FIG. 7 shows a plan view of the pronged ring according to FIG. 6.
Figure 8:
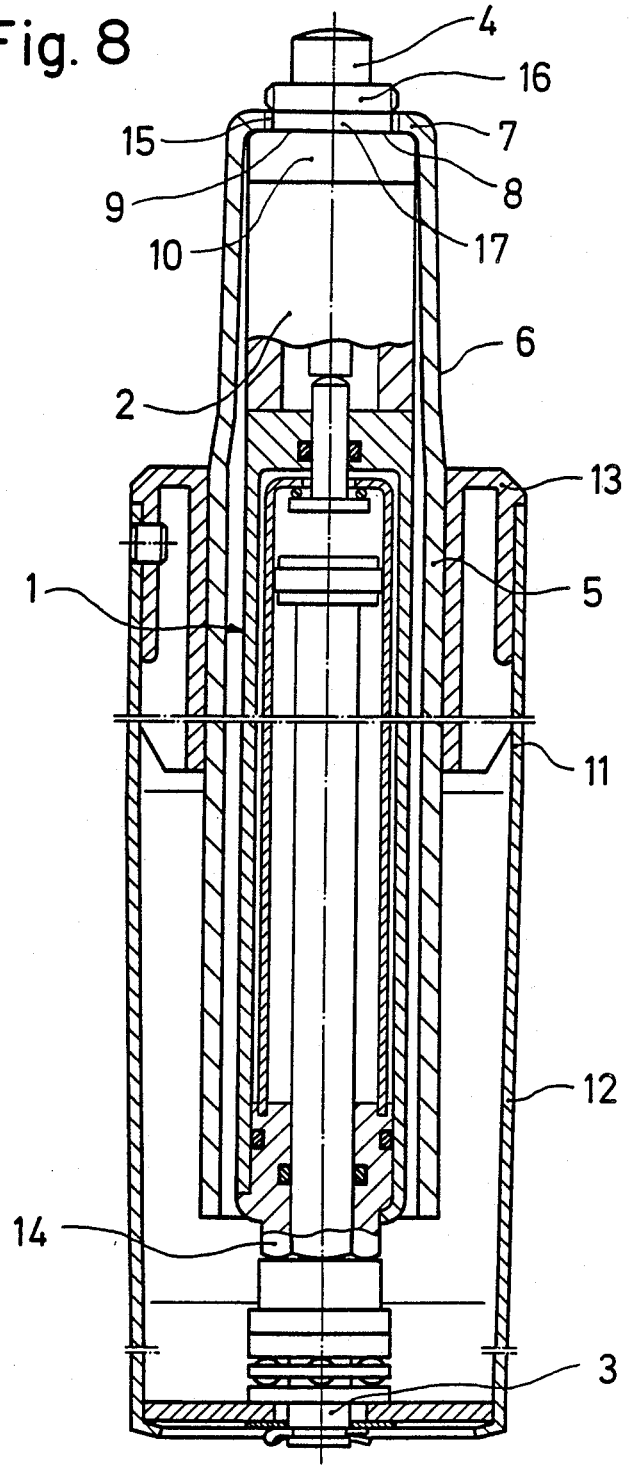
FIG. 8 shows the working chamber of the device.

The form of embodiment according to FIGS. 5, 6 and 7 differs from that according to FIGS. 1 and 2 in that a pronged ring 26 is secured on the distance piece 10, the prongs 25 of which are made to be capable of engaging in the internal threading 15 of the crimped-over taper end 7. When the gas spring 1 is in the fitted condition in the telescopic tube 5, the pronged ring 26 lies with the abutment faces 28 of the prongs 25 on the upper end of the internal threading 15, whereby the stop acting in the pulling direction is formed. The stop acting in the compression direction is formed, as in the other forms of embodiment, by the crimped-over taper end 7 and the upper end face 9.

In first assembly the gas spring 1 can be introduced into the telescopic tube 5 and then the pronged ring 26 is pressed from above on to the distance piece 10 into abutment on a corresponding collar. As shown especially in FIG. 7, for the rotation-fast connection of the pronged ring 26 with the distance piece an inner surface 27 of key face type is provided which engages with a correspondingly formed profile of the distance piece 10. For the replacement of the gas spring 1 this can be removed by rotation to the left with the pronged ring 26 turning with the prongs 25 through the internal threading 15. The replacement gas spring is provided with a pronged ring 26 from the outset and can be screwed from beneath into the threading 15. After the prongs 25 are screwed through the threading 15 and assembly has taken place, the abutment faces 28 place themselves upon the upper end of the internal threading 15.

While specific embodiments of the invention have been shown and described in detail to illustrate the application of the inventive principles, it will be understood that the invention may be embodied otherwise without departing from such principles.

It is to be noted that the reference numbers in the claims are only provided in view of facilitating the understanding of the claims. These reference numbers are by no means to be understood as restrictive.

What is claimed is:

1. A steplessly adjustable vertical movement device for chairs, tables or the like articles, which comprises a blockable gas spring (1) having a container (2) and which is secured therewith in a telescopic tube (5), while a piston rod (3) emerging downwards from the container (2) and guided in sealed manner in relation to the interior of the container (2) is detachably connected with a guide tube (11) arranged on the telescopic tube (5) for sliding by means of a guide bush (13), while the telescopic tube (5) includes a taper (6) at its upper end for connection with a part of adjustable height and the guide tube (11) is connected with a foot part, and for the securing of the gas spring (1) in the telescopic tube (5) a connection is provided which presses the gas spring (1), for the formation of an axial stop, with an upper end face against a stop face situated on the taper end, one of said gas spring and said telescopic tube (1, 5) being provided with at least one first thread element (15) which, in the fitting of the gas spring (1) in the telescopic tube (5), cooperates with at least one second thread element (16) connected with the other of said gas spring and said telescopic tube (1, 5), said first and second thread elements (15, 16) in the assembled condition of said movement device being out of thread engagement and engaging each other with axially opposed, substantially axially directed thread end faces such as to define a traction abutment system (18), said thread elements (15, 16) being threadable with respect to each other in order to release said container (2) from said telescopic tube (5).

2. Vertical movement device according to claim 1, wherein the first thread element (15) is arranged in the telescopic tube (15) while the second thread element (16) is provided on the gas spring (1).

3. A vertical movement device as defined in claim 1, wherein said taper (6) of said telescopic tube (5) is formed so that a portion of said container (2) of said gas spring (1) is accomodatable therein.

4. Vertical movement device according to claim 1, wherein the second thread element is formed by a plurality of prongs (25) arranged in uniform distribution on the circumference of a pronged ring (26), said prongs being threadably engageable within said first thread element which has an internal threading (15) so as to rest, when the gas spring (1) is in the assembled condition in the telescopic tube (5), with abutment faces (28) on the upper end of the internal threading (15).

5. Vertical movement device according to claim 4, wherein the pronged ring (26) is an elastic component which, for rotation-fast connection, includes at least one internal face (27) of spanner face type which abuts on a corresponding counter-face of the distance piece (10).

6. Vertical movement device according to claim 5, characterised in that the pronged ring (26) is secured on the distance piece (10) by means of a press connection.

7. Vertical movement device according to claim 1, wherein the first thread element (15) is formed in the telescopic tube (5) as an internal threading (15, 23).

8. Vertical movement device according to claim 7, wherein the second thread element is formed as a threaded section (16, 21) connected with the gas spring (1) so that when the gas spring (1) is in the assembled condition in the telescopic tube (5) said threaded section passes through the internal threading (15, 23) so as to be out of threading engagement therewith, while the thread end faces form the traction abutment (18, 24).

9. Vertical movement device according to claim 8, wherein the threaded section (16) is arranged on a distance piece (10) connected with the container (2), said telescopic tube having a crimped-over taper end (7) incorporating the internal threading (15) which has an axial extent which corresponds to that of an unthreaded section (17) on the distance piece (10).

10. Vertical movement device according to claim 8, wherein the threaded section (21) is arranged on a securing ring (20) situated at the piston rod exit end of the container (2), the internal threading (23) being situated at the lower end of the telescopic tube (5) and the traction abutment being formed by mutually opposite threading ends.

11. A steplessly adjustable movement device for chairs, tables or the like objects, comprising:

(a) a lockable gas spring (1);

(b) the gas spring (1) including a container (2) defining a cavity and having a longitudinal axis, an upper end, a lower end, a piston rod (3) sealingly passing through said lower end, a piston connected with said piston rod (3) within said cavity and dividing said cavity into two working chambers, a closing valve within said connection passage, a valve-actuation push member (4) extending beyond the upper end of the gas spring (1) in an axial direction and being intended for voluntary operation of said closing valve, and a pressurized gas within said cavity;

(c) the container (2) of the gas spring (1) being received by a telescopic tube (5) and releasably fastened within said telescopic tube (5) by fastening means;

(d) said fastening means including an axially acting compression abutment system (19) between the upper end of said container (2) and the upper end of said telescopic tube (5);

(e) said fastening means further including a combination of two cooperating thread elements (16, 15) on said container (2) and said telescopic tube (5), respectively, said thread elements (16, 15) in the assembled condition of said movement device being out of thread engagement and engaging each other with axially opposed, substantially axially directed thread end faces such as to define a traction abutment system (18), said thread elements (16, 15) being threadable with respect to each other in order to release said container (2) from said telescopic tube (5);

(f) the telescopic tube (5) being provided in an upper section thereof with an upwardly converging external cone (6) for the engagement into a corresponding internal cone of the chair, table or similar object;

(g) the telescopic tube (5) is with a lower section thereof slidably received by a guide tube (11) preferably through the aid of a guide bush (13);

(h) the piston rod (3) is at a location thereof outside said container (2) connected with a bottom part of said guide tube (11) by connection means, said connection means fixing said piston rod (3) with respect to said guide tube (11) in axial direction;

(i) the guide tube (11) is shaped such as to be connectable with a foot member of the respective chair, table or similar object.

12. A steplessly adjustable vertical movement device for chairs, tables or the like articles, which comprises a blockable gas spring (1) having a container (2) with an upper end which is secured therewith in a telescopic tube (5) having an inwardly curled upper end, said upper end of said container being provided so as to immediately contact the inwardly curled upper end of said telescopic tube, while a piston rod (3) emerging downwards from the container (2) and guided in a sealed manner in relation to the interior of the container (2) is detachably connected with a bottom part of a guide tube (11) arranged on the telescopic tube (5) for sliding by means of a guide bush (13), while the telescopic tube (5) includes a tapered section (6) adjacent its upper end for connection with a part of adjustable height and the guide tube (11) is connected with a foot part, and for the securing of the gas spring (1) in the telescopic tube (5) a connection is provided which holds the gas spring (1), for the formation of an axial stop, with an upper end face against a stop face situated on the inwardly curled upper end, said telescopic tube being provided adjacent its lower end with an internal thread element (23) which, in the fitting of the gas spring (1) in the telescopic tube (5) cooperates with an external thread element (21) coupled in load-transmitting relation to said container (2), said threaded elements (23, 21) being threadable with respect to each other in order to release said container (2) from said telescopic tube (5).

13. The steplessly adjustable vertical movement device according to claim 12 wherein said container (2) has an external cylindrical circumferential face of substantially consant diameter along a major part of its axial length, and upper section of said major part having said constant diameter extending within said tapered section (6) of said telescopic tube (5).

14. The steplessly adjustable vertical movement device according to claim 13 wherein said upper section extends over more than eighty percent of the axial height of said tapered section.

15. A subassembly for a steplessly adjustable vertical movement device for chairs, tables or like articles including a guide tube (11) having a closed lower end connected to a foot part for such article and an open upper end, the subassembly comprising:

a telescopic tube (5) adapted to be slidably received within the guide tube (11) and having an open first end adapted to extend downward into the guide tube (11) towards the closed lower end thereof and an inwardly curled second end (7) adapted to extend beyond the open upper end thereof, said telescopic tube (5) having a tapered portion (6) adjacent its second end that is adapted to be connected to the article to be adjusted vertically;

a blockable gas spring (1) including a sealed container (2), a piston rod (3) extending from one end of said container (2), and a blocking control member (4) extending from the other end of said container (2), said container (2) extending axially within said telescopic tube (5) with the piston rod (3) extending outwardly through the open first end thereof; and means for releasably securing the container (2) within the telescopic tube (5) between a first axial stop (8) supported by said inwardly curled second end (7) and a second axial stop defined by cooperating first and second thread elements (15, 16 and 23, 21), said first thread element (15, 23) being coupled in load-transmitting relation to one of said gas spring (1) and said telescopic tube (5) and said second thread element (16, 21) being coupled in load-transmitting relation to the other of said gas spring (1) and said telescopic tube (5), said first and second thread elements (15, 16 and 23, 21) in the assembled position of said gas spring (1) within said telescopic tube (5) being out of threaded engagement with each other but being threadable with respect to each other in order to introduce said container (2) into said telescopic tube (5) and to release said container (2) from said telescopic tube (5).

16. A subassembly according to claim 15, wherein the first thread element (15, 23) is arranged on the telescopic tube (5) and the second thread element (16, 21) is arranged on the gas spring (1).

17. The subassembly according to claim 16, wherein the first thread element (15, 23) is formed on the telescopic tube (5) as an internal threading.

18. The subassembly according to claim 17, wherein the second thread element (16, 21) is formed as a threaded section coupled in load-transmitting relation to the gas spring (1) and, when the gas spring (1) is in the assembled position in the telescopic tube (5), said threaded section passes through the internal threading (15, 23) so as to be out of threaded engagement therewith and the thread end faces form said second axial stop (18, 24).

19. The subassembly according to claim 15 wherein said container (2) has a substantially constant external diameter over a major portion of its axial length, and, when said container is secured in the telescopic tube (5) by said releasable securing means, an upper section of said major container portion extends within said tapered portion (6) of said telescopic tube (5).

20. A steplessly adjustable vertical movement device for chairs, tables or the like articles, comprising a guide tube (11) having a closed lower end and an open upper end containing a guide bush (13) for slidably engaging a telescopic tube (5) adapted to be slidably received within the guide tube and having a curled upper end and an open lower end adapted to extend into the guide tube (11) towards the closed lower end, said telescopic tube being adapted to be connected to the article to be adjusted vertically; a blockable gas spring (1) including a sealed container (2) and a piston rod (3) extending from one end of said container (2), said gas spring extending axially within the telescopic tube and the guide tube and being releasably coupled between the upper curled end of the telescopic tube and the closed lower end of the guide tube; means for releasably coupling the gas spring to the upper end of the telescopic tube comprising cooperating first and second thread element, said first thread element being coupled in load-transmitting relation to one of said gas spring and said telescopic tube and said second thread element being coupled in load-transmitting relation to the other of said gas spring and said telescopic tube, said first and second thread elements in the assembled position of said gas spring within said telescopic tube being out of threaded engagement with each other but being threadable with respect to each other in order to introduce the gas spring into the telescopic tube and to remove the gas spring from the telescopic tube.

21. A steplessly adjustable vertical movement device for chair, tables or the like articles according to claim 20 wherein the first thread element is arranged on the telescopic tube and the second thread element is arranged on the gas spring.

22. A steplessly adjustable vertical movement device for chairs, tables or the like articles according to claim 21 wherein the first thread element is an internal threading on said telescopic tube and the second thread element is an external threading carried by said gas spring and engageable with the internal threading on said telescopic tube.

23. A subassembly for a steplessly adjustable vertical movement device for chairs, tables or like articles including a guide tube having a closed lower end connected to a foot part for such article and an open upper end, the subassembly comprising:

a telescopic tube adapted to be slidably received within the guide tube and having an open first end adapted to extend downward into the guide tube towards the closed lower end thereof and an inwardly curled second end adapted to extend beyond the open upper end thereof, said telescopic tube being adapted to be connected to the article to be adjusted vertically;

a blockable gas spring, including a sealed container and a piston rod extending from one end of said container, extending axially within the telescoping tube and means for releasably coupling the gas spring to the upper end of the telescopic tube comprising cooperating first and second thread elements, said first thread element being coupled in load-transmitting relation to one of said gas spring and said telescopic tube and said second thread element being coupled in load-transmitting relation to the other of said gas spring and said telescopic tube, said first and second thread elements in the assembled position of said gas spring within said telesopic tube being out of threaded engagement with each other but being threadable with respect to each other in order to introduce said gas spring into said telescopic tube and to release said gas spring from said telescopic tube.

24. A subassembly according to claim 23, wherein the first thread element is arranged on the telescopic tube and the second thread element is arranged on the gas spring.

25. The subassembly according to claim 24, wherein the first thread element is formed on the telescopic tube as an internal threading.

26. The subassembly according to claim 25, wherein the second thread element is formed as a threaded section coupled in load-transmitting relation to the gas spring and, when the gas spring is in the assembled position in the telescopic tube, said threaded section passes through the internal threading so as to be out of threaded engagement therewith.

27. A steplessly adjustable vertical movement device for chairs, tables or the like articles, comprising:

a guide tube having a lower end and an open upper end;

a guide bush mounted within the open upper end of the guide tube;

a telescopic tube slidably received within the guide bush for movement into and out of the guide tube through said open upper end, the telescopic tube having an upper end extending from the upper end of said guide tube and an open lower end extending into the guide tube towards the lower end thereof, said telescopic tube being adapted to be connected adjacent the upper end thereof to the article to be adjusted vertically;

a blockable gas spring, including a sealed container and a piston rod extending from one end of said container, extending axially within the telescopic tube and the guide tube; and means for releasable coupling the gas spring between the upper end of the telescopic tube and the lower end of the guide tube, said releasable coupling means comprising first and second cooperatively engagable elements, said first element being coupled in load-transmitting relation to one of said gas spring and said telescopic tube and said second element being coupled in load-transmitting relation to the other of said gas spring and said telescopic tube, said first and second elements being in cooperative engagement with each other in order to introduce the gas spring into the telescopic tube and to remove the gas spring from the telescopic tube but being out of said cooperative engagement when said gas spring is in the assembled position within the telescopic tube.

28. A subassembly for a steplessly adjustable vertical movement device for chairs, tables or like articles including a guide tube having a lower end connected to a foot part for such article and an open upper end, the subassembly comprising:

a telescopic tube adapted to be slidably received within the guide tube through the open upper end thereof and having an open first end adapted to extend downward into the guide tube towards the lower end thereof and a second end adapted to extend beyond the open upper end thereof, said upper end of the telescopic tube being adapted to be connected to the article to be adjusted vertically;

a blockable gas spring, including a sealed container and a piston rod extending from one end of said container, extending axially within the telescoping tube; and means for releasably coupling the gas spring to the telescopic tube comprising first and second cooperatively engagable elements, said first element being coupled in load-transmitting relation to one of said gas spring and said telescopic tube and said second element being coupled in load-transmitting relation to the other of said gas spring and said telescopic tube, said first and second elements being in cooperative engagement with one another in order to introduce said gas spring into said telescopic tube and to release said gas spring from said telescopic tube but being out of said cooperative engagement when gas spring is in the assembled position within the telescopic tube.

* * * * *

UNITED STATES PATENT AND TRADEMARK OFFICE

CERTIFICATE OF CORRECTION

PATENT NO. : 4,940,202

DATED : July 10, 1990

INVENTOR(S) : Hans-Josef Hosan and Axel Knopp

It is certified that error appears in the above-identified patent and that said Letters Patent is hereby corrected as shown below:

Col. 3, line 1, "If" should read --In--;
Col. 8, line 53, "tube" should read --tube (5)--;
Col. 8, line 58, "threaded" should read --thread--;
Col. 8, line 66, "and" should read --an--;
Col. 10, line 16, "element" should read --elements--;
Col. 11, line 37, "releasable" should read --releasably--;
Col. 12, line 41, after "when" insert --said--.

Signed and Sealed this

Twenty-fourth Day of December, 1991

*Attest:*

HARRY F. MANBECK, JR.

*Attesting Officer*

*Commissioner of Patents and Trademarks*